United States Patent [19]

Gerwick, Jr.

[11] 4,048,943

[45] Sept. 20, 1977

[54] ARCTIC CAISSON

[75] Inventor: Ben G. Gerwick, Jr., San Francisco, Calif.

[73] Assignee: Exxon Production Research Company, Houston, Tex.

[21] Appl. No.: 690,469

[22] Filed: May 27, 1976

[51] Int. Cl.[2] ..... B63B 35/08

[52] U.S. Cl. ..... 114/256; 114/40; 61/1 F; 61/103

[58] Field of Search ..... 61/103, 94, 101; 114/.5 D, 41, 40, 256; 9/8

[56] References Cited

U.S. PATENT DOCUMENTS

| | | | |
|---|---|---|---|
| 3,766,874 | 10/1973 | Helm et al. | 61/103 X |
| 3,807,179 | 4/1974 | Stone | 114/40 X |

OTHER PUBLICATIONS

Oil & Gas Journal, Apr. 27, 1970, pp. 44–45.

Lawrence, "A Conceptual Study of the Arctic Drift Barge," Dec. 6, 1966, Gen. Dynamics Corp., Groton, Conn., pp. 1–3, 1–4.

*Primary Examiner*—Jacob Shapiro

*Attorney, Agent, or Firm*—Salvatore J. Casamassima

[57] ABSTRACT

An offshore structure, adapted for operation in an ice infested arctic environment, includes a floating caisson that can be actively heaved in the water to break ice. The caisson comprises a radially tapered upper portion, preferably conically shaped. Means for vertically moving the caisson are provided so that the upper portion of the caisson can obliquely contact ice sheets and other ice masses with sufficient dynamic force to pierce and break the ice. A plurality of mooring lines anchored to the sea floor are attached to the caisson to secure its position in the water.

19 Claims, 7 Drawing Figures

ARCTIC CAISSON

BACKGROUND OF THE INVENTION

1. Field of the Invention

This invention generally relates to offshore structures for use in arctic regions and more particularly to structures which offer protection against the dynamic forces of ice sheets and other ice masses. 2. Description of the Prior Art To meet the increasing demand for oil and gas, exploration and production of petroleum products has been extended to offshore locations which have hostile weather conditions during much of the year. Among these locations are the bodies of water located in the arctic regions of the world such as northern Alaska, Canada and Greenland. One of the major problems encountered in offshore arctic regions is the continuous formation of sheets of ice which can be as much as 8 feet thick. These ice sheets are not stationary. Under the influence of winds and sea currents, they move laterally through the water at rates of up to several hundred feet per day. Such dynamic masses of ice can exert enormous crushing forces on anything in their path. Therefore, any offshore structure which is to operate in an arctic environment must be able to withstand or overcome the dynamic forces created by moving ice.

Another danger encountered in arctic waters are pressure ridges of ice. These are huge mounds of ice which usually form within ice sheets and which may consist of snow, pack ice and overlapping layers of sheet ice. Pressure ridges can be up to 100 feet thick and can, therefore, exert proportionately greater force than ordinary sheet ice. The capacity of pressure ridges for causing the catastrophic failure of an offshore structure is very great.

Bottom supported stationary structures are particularly vulnerable in offshore arctic regions, especially in areas of deep water. All of the force of the ice sheet or pressure ridge is directed near the surface of the water. If the offshore structure comprises a drilling platform supported by a long, comparatively slender column which extends well below the surface, the bending moments caused by the laterally moving ice may well be sufficient to crush or buckle the platform.

One approach to the above problem, which has been suggested by Gerwick and Lloyd (1970 Offshore Technology Conference), comprises a bottom supported, inverted conically shaped structure. The moving ice strikes the slanted wall of the cone shaped structure and is uplifted. The uplift of the ice not only tends to break the ice, but also substantially alleviates the horizontal crushing force of the ice on the structure. However, if water depth is great (in excess of 200 feet), such a structure might be prohibitively expensive to build because the inverted conical shape would require a very substantial volume of the total hull to be below the surface of the water. Another approach, disclosed in U.S. Pat. No. 3,766,874, is a floating conical structure. Such a structure employs a hull moored to the sea bottom and having a frusto-conical shape to fracture ice impinging on the hull. Since the structure floats, it is capable of operating in deeper waters. Both of the above structures however, are designed to alleviate the crushing forces of the ice by virtue of their geometric shape. They do not possess any active ice breaking capability. Both the bottom founded platform and the moored floating structure are fairly rigid structures which cannot yield to or counter the stresses of the moving ice.

Several external ice protection systems have been proposed which actively attack the ice mass by either melting, diverting or breaking the ice. A typical protection system is described in U.S. Pat. No. 3,807,179 which discloses an apparatus in which ice lifting elements are supported around the columns or legs of an offshore platform. Means are provided for moving the elements upwardly to break and lift the ice sheet as it moves toward the structure. Another type of apparatus is described in U.S. Pat. No. 3,759,046 which discloses the use of heat transfer devices disposed along each portion of the platform legs extending through the surface of the water. The heat transfer devices warm the ice adjacent the platform legs to within about 1° or 2° C of its melting point so as to lower the strength of the ice sufficiently to permit easier breakage.

While the external systems, such as those proposed above, afford some protection against ice sheets and pressure ridges, these systems are complicated and costly and will not protect the offshore structure against extreme forces which would otherwise result in the catastrophic failure of the structure. Accordingly, in the area of offshore structures, the art has lacked a structure or system which is well adapted to an arctic environment and which is capable of withstanding the extreme forces caused by dynamic masses of ice.

SUMMARY OF THE INVENTION

The foregoing disadvantages of previously proposed systems are substantially eliminated through the provision of the present invention. The present invention comprises an offshore structure which is adapted for operation in an offshore arctic environment in which moving ice sheets and other dynamic masses of ice are present. The offshore structure in accordance with the present invention broadly comprises a floating caisson which can be actively heaved in the water to break ice. The caisson is designed to have a radially tapered upper portion. Means for vertically moving the caisson are provided so that the tapered upper portion of the caisson can obliquely contact the ice sheet or ice mass with sufficient dynamic force to break the ice.

A plurality of mooring lines, attached to the caisson at one end and to the sea floor at the other end, maintains the caisson in a relatively stable position. Clump weights are preferred for securely anchoring the mooring lines to the sea floor. The mooring lines can be tensioned and untensioned to permit active heaving of the caisson or to reposition it in the water.

The upper portion of the caisson is preferably frusto-conically shaped. In one embodiment of the invention, a truncated cone shape can be used to downwardly break the ice. In another embodiment, an invertedtruncated cone shape can be used to upwardly break the ice. Similarly, the upper portion of the caisson can be "hour glass" shaped, i.e., a double cone design comprising a truncated cone in abutting relationship with an inverted truncated cone. This double cone caisson can be used to upwardly or downwardly break the ice sheet.

DESCRIPTION OF THE PREFERRED EMBODIMENT

Figure 1:
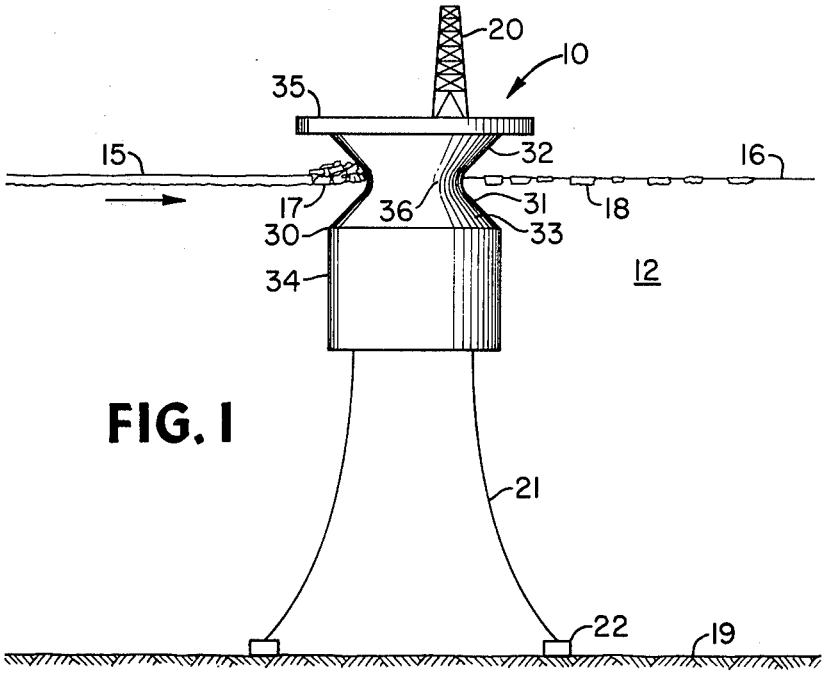
FIG. 1 is a schematic side elevational view of an offshore structure in accordance with the present invention.

FIG. 1 schematically depicts an offshore structure 10 operating in an arctic body of water 12. The structure 10 includes a platform 35 and a floating caisson 30. Caisson 30 is secured by a mooring system comprising mooring lines 21 attached at one end to caisson 30 at the other end to anchors 22 which are embedded into the sea floor 19. Platform 35 supports a drilling rig 20 as well as additional drilling and production equipment not illustrated. This invention, however, is not restricted to offshore structures used to support drilling rigs. It is suitable for any type of offshore operation conducted in arctic waters in which there is a need for protection against dynamic masses of ice.

Caisson 30 is a substantially hollow vessel except for ballast to keep the structure upright and stable. It, therefore, can be used as a storage facility for equipment and supplies and for oil and gas produced at the drilling site. Caisson 30 may also contain living quarters and other life support compartments for the peronnel working at the site.

One embodiment of caisson 30, as shown in FIG. 1, comprises a lower cylindrical portion 34 and an upper portion 31. Upper portion 31 has the shape of two opposed truncated cones 31 and 32 joined in abutting relationship, the junction of the two cones being slightly curved to provide upper portion 31 with a hyperbolically shaped throat 36. Throat 36 is shown slightly below the water level. The caisson should be ballasted to maintain truncated cone 32 substantially above surface 16 of the water, truncated cone 33 (which is inverted substantially below the surface, and lower portion 34 completely submerged at all times.

Figure 2:
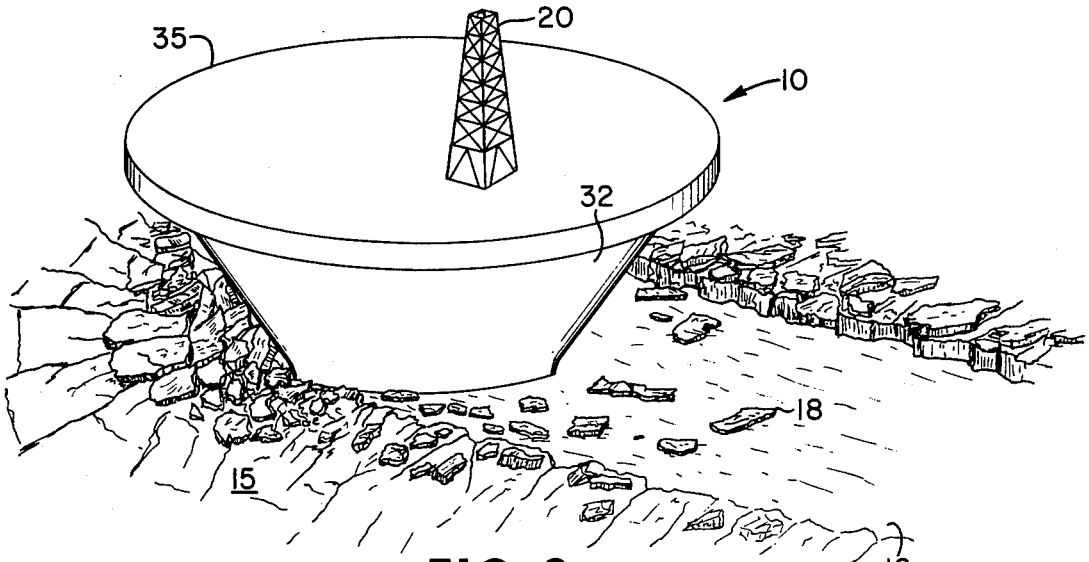
FIG. 2 is a perspective view of the offshore structure illustrated in FIG. 1.
Figure 4:
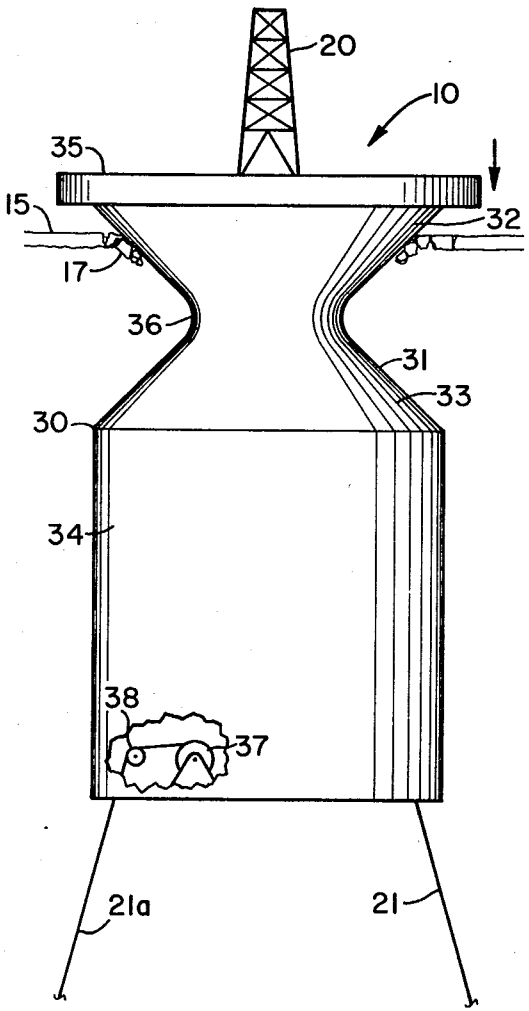

Caisson 30 is shown subjected to dynamic ice sheet 15 which slowly moves in the direction of caisson 30 as indicated by the arrow. Heaving or oscillating means (as shown in FIG. 4) cause caisson 30 to move up or down, thereby permitting either truncated cone 32 or truncated cone 33 to impact the ice. As is apparent from the drawing, the downward movement of truncated cone 32 causes the downward breaking of the ice whereas the upward movement of truncated cone 33 causes the upward breaking of the ice. Ice sheet 15 breaks into smaller segments 17 under the force resulting from the impact of the vertical oscillation of caisson 30. Ultimately, the broken ice segments divert around caisson 30 and float away in the form of ice floes 18. An overview of the offshore structure operating in ice infested, arctic waters is shown in FIG. 2.

Figure 5:
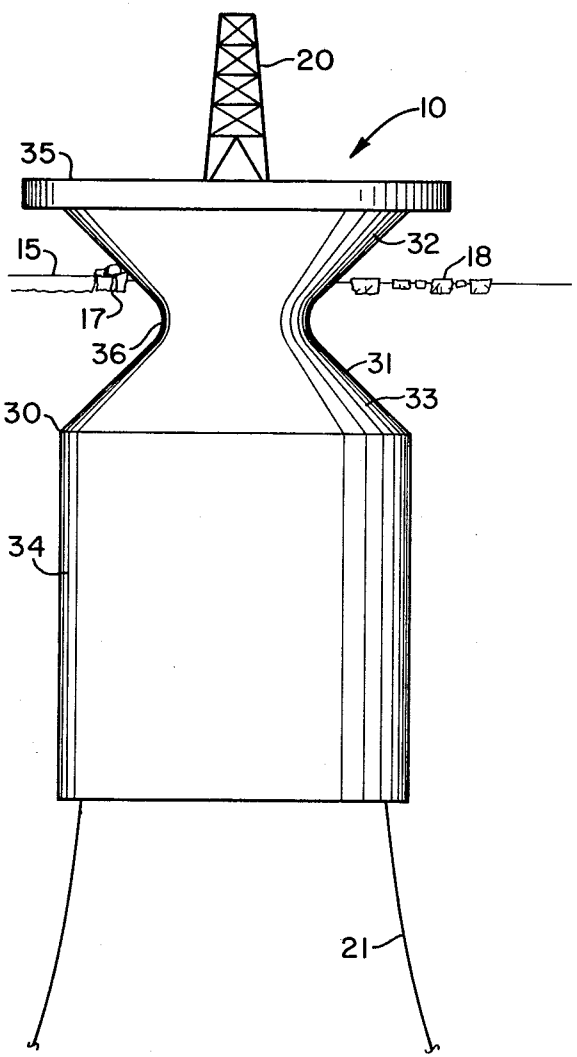
FIGS. 3, 4 and 5 are schematic side elevational views of an offshore structure in accordance with the present invention with sequentially depict the ice breaking capability of the caisson. A portion of FIG. 4 is cut away to show mechanical heaving means for the offshore structure.
Figure 3:
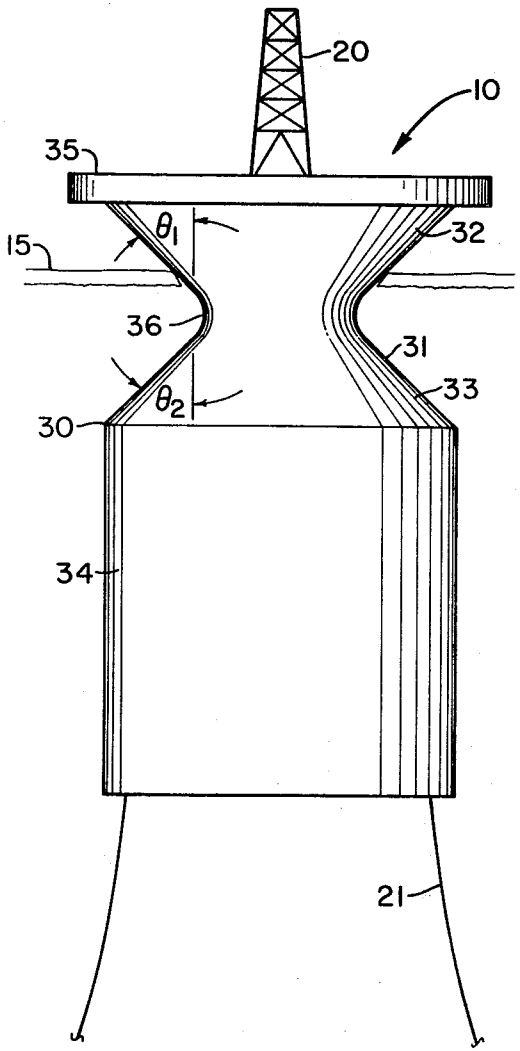

The ice breaking feature of the present invention is more clearly indicated by the sequence of drawings in FIGS. 3, 4 and 5. Ice sheet 15 is shown in FIG. 3 having advanced to where it has surrounded and impinged caisson 30. Caisson 30 is normally ballasted so that the surface of the water is either slightly above or slightly below throat 36. This positioning of caisson 30 will permit breakage of ice sheet 15 by either the upward or downward movement of the caisson. The embodiment depicted in FIG. 3 shows the water level above throat 36.

The incline angles of each cone as depicted by $\theta_1$ and $\theta_2$ in FIG. 3 are acute angles which should be steep enough to provide sufficient vertical force on the ice sheet to cause breakage. However, the angles should not be so steep as to distort the structural dimensions of the caisson. In most caisson designs, $\theta_1$ and $\theta_2$ may range between about 30° and 60° from the vertical, with a preferred range of from 40° to 50°.

FIG. 4 shows caisson 30 after it has moved in a downward direction as indicated by the arrow. Any number of means to vertically heave or oscillate caisson 30 can be employed. For example, heaving of the caisson can be induced by mechanically tensioning or relieving mooring lines 21 or by altering the buoyancy of caisson 30 such as by the discard of ballast. The former approach is illustrated in the partial cross-sectional view of lower portion 34 of caisson 30. Mechanical means for tensioning or relieving mooring line 21*a* is provided for by reel 37. Clockwise or counterclockwise rotation of reel 37 respectively pulls in or pays out mooring line 21*a* which is carried over guide roll 38. For the particular downward movement of caisson 30 depicted in FIG. 4, reel 37 would rotate clockwise to pull in mooring line 21*a*. Similarly, other reels (not shown) would pull in the remaining mooring lines to move truncated cone 32 downwardly to pierce ice sheet 15 and break it into smaller segments 17.

Figure 7:
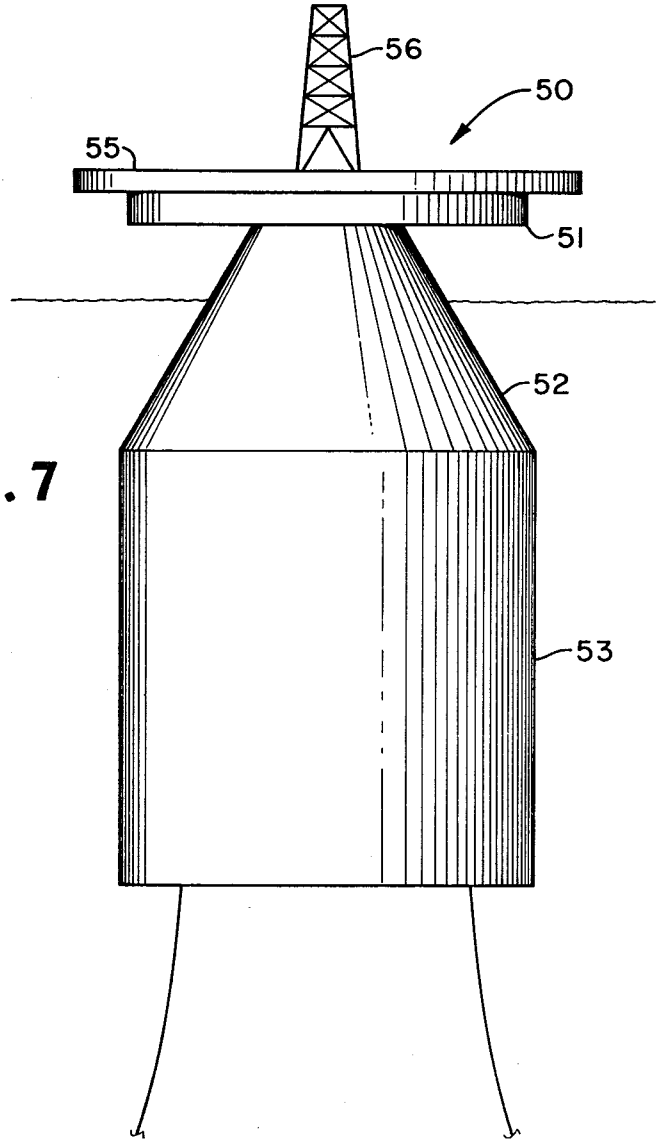
FIG. 7 is a schematic of an upwardly breaking caisson design for an offshore structure.
Figure 6:
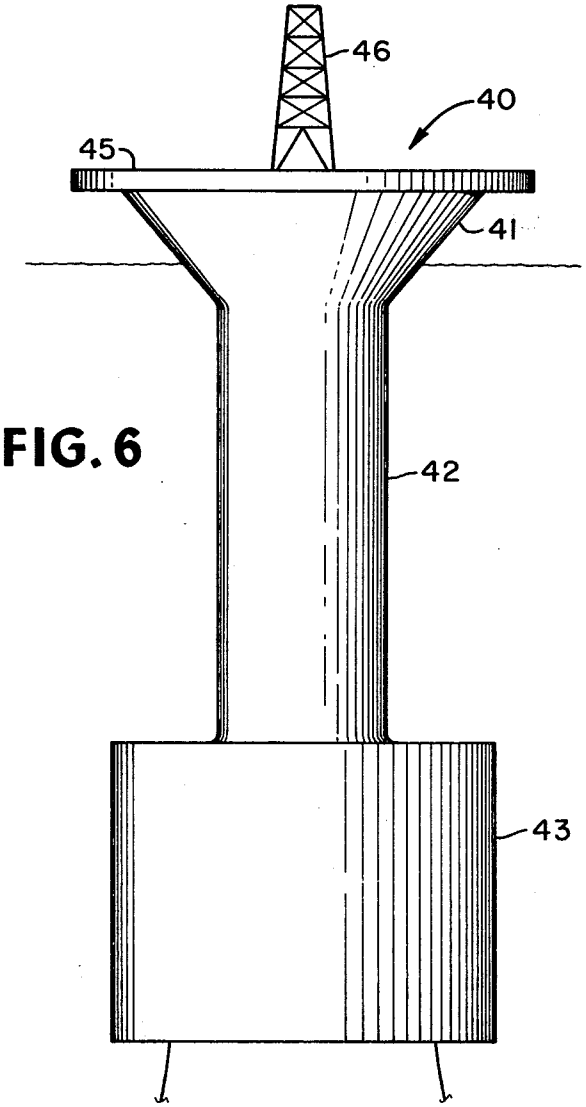
FIG. 6 is a schematic of a downwardly breaking caisson design for an offshore structure.

FIG. 5 shows caisson 30 returned to its original position. The movement of ice sheet 15 forces broken ice segments 17 against and around caisson 30 until the segments are able to break loose as ice floes 18. The ice floes eventually drift away with the sea current. FIGS. 6 and 7 illustrate other suitable caisson designs. FIG. 6 depicts a caisson 40 having a lower chamber 43 which supports column 42, truncated cone 41, platform 45 and derrick 46. This type of caisson is only capable of downwardly breaking the ice. Therefore, caisson 40 must be buoyed in the water so that all or part of the truncated cone 41 is above the water, thereby permitting downward movement of the caisson to break the ice. FIG. 7 depicts an upward breaking caisson design. Caisson 50 comprises a lower cylindrical portion 53 supporting truncated cone 52, platform 55 and derrick 56. A support base 51 to buttress platform 55 is also shown. With this type of caisson, the surface of the water must be above the line of intersection between lower portion 53 and truncated cone 52. Preferably, caisson 50 should be buoyed so that the water level is near support base 51, as indicated in the drawing. Ice is broken with this type of structure by the upward movement of caisson 50.

Many other types of caisson configurations are possible. For example, the upper ice breaking portion of the caisson can be frustoconically, hyperbolically or parabolically shaped. The main characteristic is that the upper icebreaking portion of the caisson should be tapered radially so that upon vertical movement of the caisson, the icebreaking portion will contact the ice sheet with enough force to break through the ice. Any design which permits the ice sheet to be either upwardly or downwardly broken by the vertical heaving or oscillation of the caisson is satisfactory. Thus, the caisson can be designed to upwardly or downwardly break the ice or to do both.

DESIGN CRITERIA

The caissons used in the arctic regions must operate under extremely hostile environmental conditions and in water depths over 300 feet. The caisson, mooring lines and anchors should be capable of withstanding the impact of 10 foot thick ice sheets, 30 to 100 foot pressure ridges, and hummocks, ice islands and icebergs of all sizes. In addition, the caisson should withstand waves having a 100 foot maximum wave height and winds having a maximum velocity of over 150 miles per hour.

To operate under such conditions, the caisson must have sufficient mass and must be constructed of high strength materials. The overall vertical length of the caisson normally should be between about 200 and 800 feet, with about 150 to 600 feet of the caisson's length being below the surface of the water. Overall maximum width, exclusive of the width of the drilling platform, should be anywhere from about 75 to about 400 feet, depending on the caisson's length. The weight of the caisson would primarily depend on the amount of ballast needed to keep the caisson buoyed to the proper level and on the geometric design of the caisson. A 400 feet long caisson would, for example, have a dead weight of between about 250 and 600 million pounds, with ballast constituting about half of the total weight.

Essential to the successful operation of the caisson is the mooring system. Preferably, the caisson should be moored with from eight to 16 wire cable mooring lines, each line having a diameter of from 4 to 5 inches. The mooring lines should be anchored to clump weights and each should have a maximum allowable tension of at least 1000 kips (1 kip = 1000 pounds of force). Assuming proper placement and tensioning of the mooring lines, the mooring system will permit the caisson to displace laterally (surge), displace vertically (heave) and to heel (pitch) when a force is exerted on the caisson by a dynamic ice mass. The righting moment of the caisson, the spring constant of the mooring lines and the presence of damping forces will permit the caisson to initially yield to the ice forces and then to counter the ice forces. When the ice breaks or fails, the force exerted against the caisson decreases and the energy stored in the caisson and mooring system will tend to spring the caisson back towards its original position.

The mooring system can also be used to provide the caisson with the active heaving response necessary to break sheet ice. For example, means for actively heaving the caisson can be a pulling machine actuating heavy duty cable grips which are connected to the mooring lines. The pulling machines and grips could induce heaving of the caisson by either tensioning or relieving the mooring lines. In addition, by selectively tensioning or relieving certain mooring lines, the caisson can be laterally moved through the water to avoid icebergs and large ice floes or to position the caisson at a different drilling location.

MODEL TESTS

Several caisson models were tested under simulated arctic conditions. The purpose of the tests was to determine whether the floating caisson was a feasible concept and whether active heaving of the caisson would effectively break sheet ice. Caisson models were built from steel and fiberglass components on a scale factor of 1/75th of the actual size. All other scale factors for the test program, such as ice thickness and velocity were based on corresponding scaling laws for a geometric scale factor of 75. The caisson models were designed along the lines of a single cone model as illustrated by FIG. 7 and a double cone model as illustrated by FIG. 1. The double cone model was used to test both downbreaking and upbreaking of the ice.

Tests were conducted in a climate controlled water basin. A proportionately sized sheet of ice, formed in the basin, was directed at the floating caisson model at various velocities. The model was moored in place by mooring springs. Active heaving of the caisson model was achieved by alternately adding and removing weight to the top of the model so that the model would vertically move about 1 inch, the equivalent to a full size caisson vertically moving about 7 feet.

Tests were conducted to simulate a moving ice sheet having a thickness of about 8 feet. Initial tests were unsuccessful because the models did not have a sufficiently long righting arm. (A righting arm is the distance between the center of gravity and the center of buoyancy of a floating object and is a measure of its ability to position upright in water.) Prior mathematical calculations indicated that a full scale caisson should have a righting arm of at least 20 feet to provide the caisson with sufficient stability when impacted with up to 10 foot ice sheet. Proportionate modifications were made on the caisson models to give them righting arms equivalent to 20 feet.

The results of the tests, to be more meaningful, were converted to their scaled up equivalent for a full sized caisson. Measurements were made, with and without active heaving of the caisson, to determine the surge of the caisson under the force of the ice sheet as well as the change in upstream tension on the mooring lines.

The tests conclusively demonstrated that caissons, constructed according to the present invention, can operate in the most hostile offshore arctic environment. Active heaving of the caisson significantly improves its performance in ice infested waters. For example, surge, the horizontal movement of the caisson, is reduced anywhere from 34 to 66 percent by active heaving. Also significant is the reduction of tension on the mooring lines. Tension on the upstream mooring lines is severe in the absence of active heaving, especially with the single cone caisson model. In fact, the tension exceeded the maximum allowable tension of 1000 kips at ice velocities of 0.023 and 0.102 knots for the single cone caisson. On the other hand, active heaving of the caisson reduced tension on the mooring lines by at least 50 percent in all cases and by more than 80 percent in three cases.

The reduction of surge and mooring line tension through the use of active heaving is attributable to several factors. In addition to breaking the ice sheet, active heaving reduces friction forces exerted on the caisson by the ice because of the continuous washing of the caisson surface and reduces the impact force of the ice because broken ice fragments do not build up. Active heaving also prevents adfreezing, which is the buildup of broken ice pieces into a solid mass on the surface of the caisson.

The tests also afforded a comparison between upbreaking and downbreaking of the ice sheet. The downbreaking cone design appears to offer advantages (with and without heaving) over the upbreaking design in that it exhibited improved performance over the upbreaking design with regard to both surge and mooring tension. The probable reason for the improved performance is that with the upbreaking cone the ice sheet, as it breaks, rides up on to the cone, causing the caisson to support the weight and force of the broken ice fragments. On the other hand, the downbreaking cone tends to push the broken ice downwardly, thereby diverting it away from the caisson.

It should be apparent from the foregoing that the present invention offers significant advantages over offshore arctic drilling structures previously known to the art. While the present invention has been described primarily with regard to the foregoing embodiments, it should be understood that the present invention cannot be deemed limited thereto but rather must be construed as broadly as all or any equivalents thereof.

I claim:

1. An offshore structure which is adapted for operation in an arctic sea containing floating ice masses comprising:

a floating caisson, said caisson having a radially downwardly tapered upper ice-breaking portion;

a plurality of mooring lines secured at a first end to said caisson and at a second end to the sea floor; and means for vertically moving said caisson a sufficient distance and with sufficient dynamic force so that said upper portion of said caisson obliquely contacts and breaks said ice masses.

2. The offshore structure of claim 1 wherein a drilling platform is positioned on top of said caisson, said drilling platform being equipped to conduct earth drilling operations.

3. The offshore structure of claim 1 wherein said upper portion tapers at an angle of between about 30° and 60° from the vertical.

4. The offshore structure of claim 1 wherein said upper portion tapers at an angle of between about 40° and 50° from the vertical.

5. The offshore structure of claim 1 wherein said upper portion of said caisson is in the shape of a truncated cone which is maintained substantially above the sea surface and wherein said means for vertically moving said caisson permits said upper portion to move in a downward direction to strike and break said ice masses.

6. The offshore structure of claim 1 wherein said upper portion of said caisson is in the shape of an inverted truncated cone which is maintained substantially below the sea surface and wherein said means for vertically moving said caisson permits said upper portion to move in an upward direction to strike and break said ice masses.

7. The offshore structure of claim 1 wherein said upper portion of said caisson has an opposed double cone shape comprising a truncated cone in vertical abutting relationship with an inverted truncated cone, the junction of said cones being maintained at approximately the sea surface and wherein said means for vertically moving said caisson permits said upper portion to move in both a downward direction and an upward direction to strike and break said ice masses.

8. The offshore structure in claim 1 wherein said caisson has a conically shaped upper portion and a cylindrically shaped lower portion.

9. The offshore structure in claim 1 wherein said caisson has an overall vertical length of between about 200 and 800 feet.

10. The offshore structure in claim 1 wherein the distance between the center of gravity and the center of buoyancy of said caisson is at least 20 feet.

11. The offshore structure in claim 1 wherein said caisson has a dead weight of between about 250 and 600 million pounds.

12. The offshore structure of claim 1 wherein said mooring lines are secured to the bottom of said body of water by clump weight anchors.

13. The offshore structure of claim 1 wherein said mooring lines have a maximum allowable tension of at least 1 million pounds.

14. The offshore structure of claim 1 wherein said means for vertically moving said caisson comprises a pulling machine which actuates cable grips attached to said mooring lines.

15. An offshore structure which is adapted for drilling operations in an ice infested arctic sea comprising:

a floating caisson, said caisson having an upper portion which is radially downwardly tapered at an angle of between about 30° and 60° from the vertical;

a plurality of mooring lines secured at a first end to said caisson and at a second end to the sea floor; and means for tensioning and untensioning said mooring lines so that said caisson can be moved vertically a sufficient distance and with sufficient dynamic force to permit said upper portion of said caisson to obliquely contact and break floating ice masses which impinge upon said caisson.

16. In a method conducting drilling operations from a floating caisson in an arctic sea containing floating ice masses, said caisson having a radially downwardly tapered upper ice-breaking portion, the improvement comprising vertically moving said caisson a sufficient distance and with sufficient dynamic force so that the upper portion of said caisson obliquely contacts and breaks said ice masses.

17. The method claim 16 wherein said caisson is vertically moved a distance of about 7 feet.

18. In a method of conducting drilling operations from a floating caisson in an arctic sea containing floating ice masses, said caisson having a radially downwardly tapered upper ice-breaking portion and being secured to the sea floor by a plurality of mooring lines attached to said caisson, the improvement comprising:

sequentially tensioning and untensioning said mooring lines to vertically move said caisson a sufficient distance and with sufficient dynamic force so that the upper portion of said caisson obliquely contacts and breaks said ice masses.

19. The method of claim 18 wherein said caisson is vertically moved a distance of about 7 feet.

* * * * *